United States Patent [19]

Cooper et al.

[11] 4,330,166

[45] May 18, 1982

[54] ELECTRICAL CONNECTOR SUBSTANTIALLY SHIELDED AGAINST EMP AND EMI ENERGY

[75] Inventors: Earl A. Cooper, Venice; Bennett L. Hallenbeck, Santa Monica, both of Calif.

[73] Assignee: Automation Industries, Inc., Greenwich, Conn.

[21] Appl. No.: 67,196

[22] Filed: Aug. 16, 1979

[51] Int. Cl.[3] ..... H01R 13/648

[52] U.S. Cl. ..... 339/143 R

[58] Field of Search ..... 339/14 R, 143 R, 177 R, 339/177 A, 89 R, 89 CM, 90 R, 90 C, 255 RT, 256 RT, 45 M; 174/84 S, 88 S, 35 R, 35 C

[56] References Cited

U.S. PATENT DOCUMENTS

| | | | |
|---|---|---|---|
| 3,496,519 | 2/1970 | Vetter | 339/45 M |
| 3,609,632 | 9/1971 | Vetter | 339/14 R |
| 3,739,076 | 6/1973 | Schwartz | 339/177 R UX |
| 3,835,443 | 9/1974 | Arnold et al. | 339/143 R X |
| 4,106,839 | 8/1978 | Cooper | 339/89 M X |

*Primary Examiner*—Eugene F. Desmond

*Attorney, Agent, or Firm*—Francis N. Carten

[57] ABSTRACT

This invention is directed to an electrical connector having substantial shielding effectiveness against EMI energy and especially against EMP energy. The invention improves on known EMI shielded connectors by adding a conductive spring washer, such as a wave washer made from beryllium copper alloy. The spring washer is seated in the plug portion of the connector so as to make electrical contact with the receptacle portion when the plug and the receptacle are mated.

9 Claims, 3 Drawing Figures

Fig. 3.
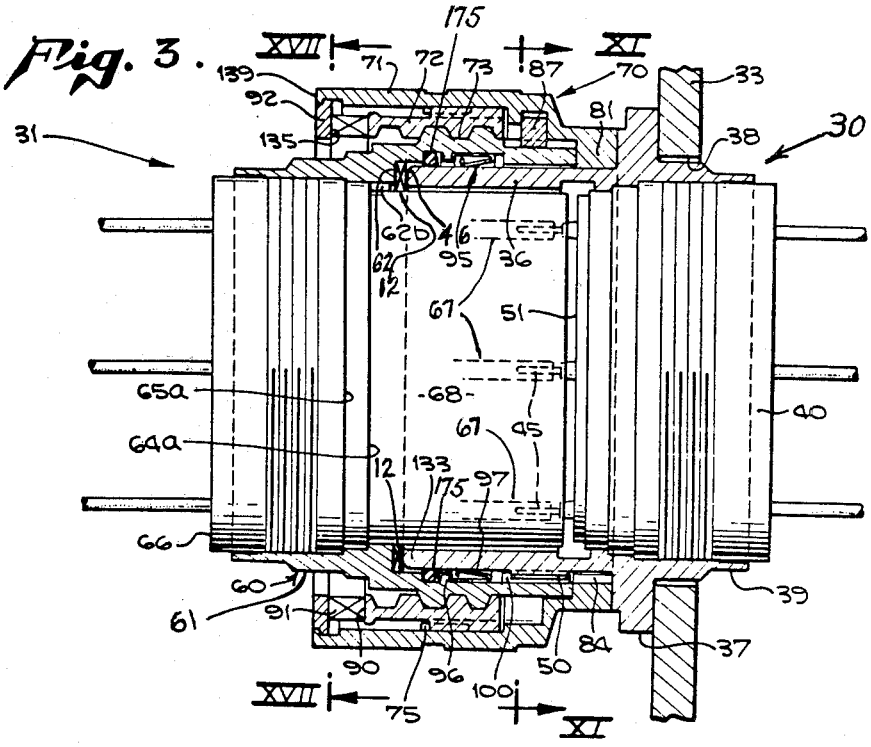
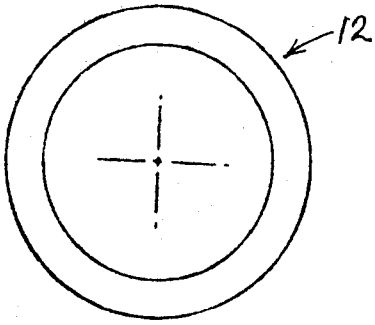
FIG. 1.
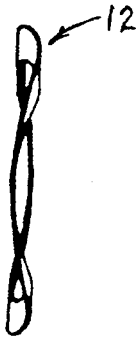
FIG. 2.

ELECTRICAL CONNECTOR SUBSTANTIALLY SHIELDED AGAINST EMP AND EMI ENERGY

BACKGROUND OF THE INVENTION

1. Field of the Invention

This invention relates to electrical connectors. More particularly, this invention relates to electrical connectors having substantial shielding effectiveness against electromagnetic interference and especially against electromagnetic pulse.

2. Description of the Prior Art

Electrical circuitry often must be protected from disruptions caused by electromagnetic interference (EMI) entering the system. External EMI energy is an undesired conducted or radiated electrical disturbance than can interfere with the operation of electronic equipment. Internal EMI energy is the unwanted noise or unwanted interference generated by electrical or electronic circuitry within a system. The EMI disturbance can occur anywhere in the electromagnetic spectrum. Radio Frequency Interference (RFI) is now used interchangeably with EMI but generally is limited to interference in the radio communication band. Connectors are particularly susceptible to EMI energy because of the numerous contact areas and openings for cable and external electrical contacts. However, the art has developed sophisticated electrical connectors having substantial shielding effectiveness against EMI (often referred to as EMI/RFI) energy. Illustrative prior art connectors of good to superior shielding effectiveness are set out in U.S. Pat. Nos. 3,609,632 and 4,106,839.

With the development of nuclear explosives, another type of electromagnetic radiation was observed. The nuclear explosion, and in some circumstances large scale chemical explosions, produces a sharp pulse (large impulse-type) of radio frequency (long wave length) electromagnetic radiation. The intense electric and magnetic fields created by electromagnetic pulse (EMP) energy can damage unprotected electrical and electronic equipment over a wide area. As a result, a demand has arisen for electrical connectors having substantial shielding effectiveness against EMP and EMI energy threats.

INCORPORATION BY REFERENCE

Applicants incorporate all the figures and the description present in U.S. Pat. No. 4,106,839, issued Aug. 15, 1978, into the instant application. FIGS. 1, 10 and 12–16 are especially relied on. It is to be understood the embodiment set out in U.S. Pat. No. 4,106,839 is merely a preferred embodiment of a prior art electrical connector effective in shielding against EMI energy. The improvement of the instant invention is applicable broadly to electrical connectors having substantial shielding effectiveness against EMI energy as defined in the background discussion.

SUMMARY OF THE INVENTION

The invention herein is an improvement in electrical connectors having substantial shielding effectiveness against EMI energy. The improvement provides an electrical connector having substantial shielding effectiveness against EMP energy. The improvement comprises: A conductive spring washer, for example, a conductive wave washer, suitably made of beryllium copper alloy, is seated in the plug portion of the connector so as to make electrical contact with the receptacle portion of the connector when the plug and receptacle are mated.

SHORT DESCRIPTION OF THE FIGURES

FIG. 1 is a plan view of a wave washer used in this embodiment of the invention.

FIG. 2 is a side view of the wave washer of FIG. 1.

FIG. 3 is a partial sectional view of a complete electrical connector embodying the invention.

DETAILED DESCRIPTION OF AN EMBODIMENT

FIGS. 1 and 2 show a particular embodiment of the conductive spring washer used in the electrical connector of the invention, namely, a conductive wave washer. FIG. 2 shows this wave washer to have three waves or points of contact. "Points of Contact" are the number of points at which the wave washer contacts a flat surface. In this embodiment, wave washer 12 is made from beryllium copper alloy which has been gold plated. Any noble metal may be used, if desired, for surface coating. Any conductive material, metal or non-metal, possessing the necessary spring property may be used. It is to be understood the foregoing is by way of illustration and does not limit the conductive spring washer used in the electrical connector of the invention to the illustrated wave washer.

FIG. 3 is view of a mated electrical connector of the invention in partial section along plane XVII—XVII and along plane XI—XI. (It is pointed out that instant FIG. 3 is identical to FIG. 10 of U.S. Pat. No. 4,106,839 except for the addition of wave washer 12.)

In the embodiment of FIG. 3, receptacle 30 includes a receptacle shell 36 comprising a cylindrical wall having a radially outwardly directed annular flange 37 which may be placed against the front face of wall 33 and secured thereto, for example, by bolts (not shown). Receptacle shell 36 extends through an opening 38 in wall 33 and may include a back cylindrical shell wall 39 which extends beyond the back face of wall 33.

Receptacle shell 36 receives and holds a composite insert member 40 of cylindrical form. The front portion of insert member 40 may be made of a resilient dielectric material and the back portion may be made of a relatively hard dielectric material. Contact pins 45 project from conical bosses formed of the resilient dielectric material, the bosses providing circular sealing contact with hard dielectric material surrounding corresponding socket contacts in the plug 31. The axial position of insert member 40 in receptacle shell 36 is such that contact pins 45 carried thereby have their pin ends spaced a predetermined distance inwardly from the nose (edge face) 46 of receptacle shell 36. Contact pins 45 are thereby exposed for mating contact with the plug 31 relatively deeply within the chamber formed by receptacle shell 36 and are protectively enclosed by receptacle shell 36. Means may be provided to avoid mismatching of receptacle 30 and plug 31.

A master key 50 is provided on receptacle shell surface 36 to angularly orient the plug 31 and receptacle 30.

The interconnection at the insert member between the cables, the insert member 40, and contact pins 45 may be made in any suitable manner. It is to be understood that insert member 40 holds firmly the contact pins 45 against relative axial movement and that electrical continuity through the length of the connector is preserved by insert member 40 without electrical leakage loss.

Plug 31 comprises a plug shell 60 having a particularly configured cylindrical wall 61 having an internal diameter slightly greater than the outer diameter of receptacle shell 36 so that shell 36 may be axially and telescopically received therewithin. The plug shell 60 includes an internal annular flange 62 serving to index axially plug insert member 66 with respect to the plug shell 60. A plastic key **62*b* on insert member 66 angularly indexes member 66 with respect to plug shell 60. A cylindrical plug insert member 66 of suitable hard dielectric material receives ends of cables which are electrically connected within insert member 66 to electrical socket contacts 67 spaced and arranged about the axis of the plug insert member to correspond with the spacing and arrangement of the contact pins 45 on the receptacle insert member 41. The cylindrical portion 68 of the plug insert member 66 has an outer diameter which is slightly less than the inner diameter of receptacle shell 36. The outer cylindrical surface of insert member portion 68 defines with the internal cylindrical surface of the cylindrical wall 61 of plug shell 60 an annular space for reception of receptacle shell 36** during mating of the plug and receptacle.

Plug 31 also includes means for coupling or connecting the plug and receptacle whereby the pin and socket contacts 45 and 67 respectively are properly aligned for electrical mating contact when the receptacle and plug shells 36 and 60 respectively are coaxially drawn together into full electrical mating and mechanical locking engagement. Herein, the coupling means generally indicated at 70 includes a coupling ring housing 71 and a coupling nut 72 within coupling housing 71 and provided with threaded engagement at 73 with external threads provided on cylindrical wall 61 of plug shell 60. Coupling ring housing 71 is provided on its internal surface with a plurality of circumferentially spaced radially inwardly directed lands 75 and grooves (not shown) for cooperation with complimentary lands grooves on coupling nut 72. Coupling ring housing 71, when turned about the axis of the connector, will transmit such turning forces through coupling nut 72 to the interleaved lands and grooves of the plug shell 60 while preventing relative longitudinal or axial movement between coupling housing 71 and coupling nut 72.

Coupling housing 71 is provided with a coupling end portion with a radially inwardly directed breech flange 81. The inner diameter of flange 81 is slightly greater than the outer diameter of receptacle shell 36 so that shell 36 may be inserted through the breech flange opening for reception between the plug shell 60 and the plug insert member 66.

Coupling housing 71 also includes a groove to receive a spring detent 87 to audibly and tactilely signal full locked and unlocked condition of the plug means and receptacle means.

Coupling housing 71 also encloses an annular spring 91 which imparts an axially directed spring force against coupling nut 72. Nut 72 provides an annular seating face 90 for one end of spring 91 which is seated at its opposite end against an annular retaining member 92 breech interlocked with coupling housing 71.

The threaded engagement at 73 between plug shell 60 and coupling nut 72 comprises a four lead fast thread adapted to rapidly advance axially plug shell 60 into full mated relationship with receptacle shell 36 upon rotation of coupling ring housing 71. Acme stub thread is a suitable thread.

For electrical continuity with respect to ground and electromagnetic interference, shield 95 is carried within plug shell 60 for engagement with receptacle shell 36. Shield 95 is positioned on an annular rib 96 provided on the interior surface of plug shell 60 to securely position shield 95. Shield 95 comprises a plurality of resilient fingers 97 which are adapted to be compressed by the forward portion of receptacle 36 to provide electrical contact therewith.

The resilient fingers 97 may be plated with a noble metal, such as gold. The surfaces contacted by the fingers also may be plated with a noble metal. In fully mated position, plug shell 60 and receptacle shell 36 provide a substantially continuous 360° electrically conductive path of low resistance between the metal shells 60 and 36 through the shield 95. Electromagnetic shield 95 shields the connector against electromagnetic energy in the radio frequency range of about 100 MHz to about 10 GHz.

Wave washer 12 is seated in plug 31 abutting the inward face of internal annular flange 62. When plug 31 is mated with receptacle means 30, wave washer 12 is compressed by the nose 46 of receptacle shell 36 and the face of flange 62 to provide conductive spring contact areas (paths) for effective grounding and electrical continuity between the two shells with respect to EMP energy.

Coupling ring housing 71 with enclosed coupling nut 72 and spring 91 bearing against one end of the coupling nut are retained in assembly by annular retainer member 92. Annular retainer member 92 has an inner diameter approximately the same as the inner diameter of coupling nut 72 and provides an inner annular surface 135 against which one end of spring 91 may seat in assembly. The outer circumference of member 92 is provided with arcuate circumferential breech lands or lugs, not shown, in spaced relation and defining openings therebetween, not shown.

The coupling assembly breech retainer member 92 may be sleeved over plug shell 60 with breech lugs aligned with openings provided in end portion 139 of coupling housing 71. By using a suitable tool, annular members 92 can be pressed uniformly axially toward coupling nut 72 against the force of spring 91 and rotated. Upon release of the installing pressure, retainer member 92 is urged axially outwardly by spring 91.

Disassembly of the retainer member 92 from the coupling housing 71 is accomplished by a reversal of the installation steps described above. The assembly tool is employed to exert an axial pressure on the retainer member 92 to force it axially inwardly against the spring pressure and then to rotate the ring through the necessary angle to align the breech lugs with the openings in the end portion of the coupling ring housing 71. Upon release of tool pressure, retainer member 92 is withdrawn from the end portion of coupling ring housing 71. Spring 91 and the coupling ring housing 71 and associated coupling ring nut may then be removed.

When the receptacle 30 and plug 31 are mated, receptacle shell 36 makes contact with EMI fingers 97 and, beyond the rib 96, shell 36 makes a water seal contact with member 175, seated in a channel cut into wall 61 of plug shell 60, adjacent to rib 96. In this embodiment, member 175 is a silicone rubber O-ring. As the two shells mate, the nose 46 of receptacle shell 36 compresses wave washer 12 against the face of plug internal flange 62 to produce a tight electrical lockup of the receptacle 30 and plug 31 and shielding effectiveness against EMP energy.

Insert members 40 and 66 are precisely axially positioned and angularly accurately oriented with respect to their respective shells so that proper alignment and mating of the pin and socket contacts may be accomplished. It should be noted that breech flange 81 on the coupling ring housing 71 includes two radially inwardly projecting keys, not shown, located about 120° apart and approximately the same angular distance with respect to keyway 84. Keyway 84 receives master key 50 on the receptacle shell for orienting the two shells with respect to one another so as to achieve axial alignment of mating pin and socket electrical contacts. In the instant embodiment, visible reference indicia are provided on the coupling housing and on the shell in linear alignment with the key 50 and keyway 84 so that the coupling housing, the plug shell and receptacle shell are properly angularly oriented for mating of the pin and socket contacts.

Advancement of the plug shell 60 to full electrical contact of the contact pins and contact socket is accomplished by turning the coupling ring in one direction through 90°. Turning of coupling ring housing 71 drives the coupling nut 72 which moves plug shell 60 axially without rotation toward the receptacle 30. Plug shell 60 is held against rotation by interlocking key 50 on the receptacle shell and the keyway 100 on the plug shell, master key 50 having entered keyway 100 upon the last axial movement of the plug 31 and having become disengaged the keyway 84 on coupling ring housing 71. Thus the coupling ring 71 may be turned relative to the shells; however, plug and receptacle shells are held against relative rotation by the key and keyway 50 and 100. Since the pin and socket contacts have been aligned, the ends of the pins enter the sockets for electrical engagement. Upon completion of turning the coupling housing through 90° breech locking lugs on the coupling housing are located between the locking lands on the receptacle shell and the annular flange 37 formed thereon. Relative axial movement of the coupling housing with respect to the receptacle shell is thereby prevented.

PERFORMANCE

A number of electrical connectors as described in FIGS. 1–3 were built in two shell sizes, No. 11 and No. 25. The shells were made of nickel plated aluminum. The wave washers were gold plated beryllium copper alloy. The No. 11 wave washer has five waves (points of contact). The No. 25 wave washer has eight waves (points of contact).

The two sets of connectors were turned over to an independent testing agency. Similar sets of connectors were supplied by four other suppliers, hereinafter spoken of as comparative connectors. The intended area of use of all connectors is in ICBMs.

The general test procedure is called: Transfer Impedance Measurement. For this test a particular method named Rapid Attenuation Measurement System (RAMS) was used. The shielding effectiveness was determined while each connector was exposed to simulated flight dynamics of three minutes duration. The measurements were made at: (1) dwell at 5 MHz rf drive during the first minute of vibration, (2) dwell at 25 MHz rf drive during the second minute of vibration, and (3) sweep from 1 to 100 MHz rf drive (EMP conditions) during the third minute of vibration. The results were plotted on chart paper with Attenuation, dB 90–160, on the ordinate scale and frequency 1–100 MHz on the abscissa scale. Only condition (3) gives a trace across the chart.

The results for the comparative connectors in the small size shells, No. 10–14, showed some flat traces but mostly traces tilted up or down across the abscissa scale. An average was taken from a low of about 90 dB to a high of about 112 dB. Applicants' connectors showed a flat trace at about 132 dB. This is an improvement over the comparative connectors of about 20–40 dB or, converting to a "times" (×) basis, applicants' connectors gave about 10–100× better shielding than the comparative connectors.

The results for the comparative connectors in the large size shells, No. 22–25, showed for almost all connectors a tilted trace with an average from a low of about 104 dB to a high of about 118 dB. Applicants' connectors had a flat trace at about 133 dB. This is an improvement over the comparative connectors of about 15–30 dB or, converting to a "times" (×) basis, applicants' connectors gave about 6–32× better shielding than the comparative connectors.

The results given above are conservative with respect to applicants' connectors. Applicants' connectors contained a full complement of contacts. The comparative connectors contained only three contacts. It should be noted that greater attenuation is obtained as the quantity of contacts in the connector is decreased.

The advantages of the present invention, as well as certain changes and modifications to the disclosed embodiments thereof, will be readily apparent to those skilled in the art. It is the applicants' intention to cover all those changes and modifications which could be made to the embodiments of the invention herein chosen for the purposes of the disclosure without departing from the spirit and scope of the invention.

Thus having described the invention, what is claimed is:

1. An electrical connector comprising:

a receptacle means including a conductive receptacle shell having an edge face, a plug means including a conductive plug shell having an internal annular flange, electrical contact elements carried within said receptacle shell and within said plug shell for electrical mating and unmating of said two shells, said receptacle means and said plug means being movable relative to each other along an axis into and out of mated and unmated positions, electromagnetic interference shielding means comprising:

an annular member including a band having a cylidrical surface seated against the internal surface of one of said shells, means connected with one edge portion of said band for securing the annular member to said one shell, and a plurality of folded resilient fingers connected with the other edge portion of said band and in converging relation to said axis for biased pressure contact with said internal surface of said one shell and for biased pressure contact with the other of said shells, and electromagnetic pulse shielding means comprising:

a conductive solid wave washer seated in said plug means so as to be compressed between said edge face and said annular flange when said plug means and said receptacle means are mated.

2. The electrical connector according to claim 1, wherein said wave washer is made from beryllium copper alloy.

3. The electrical connector according to claim 2, wherein said wave washer is gold plated.

4. The electrical connector according to claim 1, wherein said fingers of said electromagnetic interference shielding means are gold plated.

5. In an electrical connector comprising receptacle means including a conductive receptacle shell having an edge face and enclosing a first set of electrical contacts, and plug means including a conductive plug shell having an internal annular flange and enclosing a second set of electrical contacts, said receptacle means and said plug means being movable relative to each other along an axis into and out of mated and unmated positions, the improvement comprising:

conductive solid spring washer means compressed between said edge face and said annular flange when said receptacle means and said plug means are in the mated position, and operative in co-operation with said receptacle shell and said plug shell to shield said electrical contacts against electromagnetic pulse energy.

6. The improvement according to claim 5, wherein said conductive solid spring washer means is seated in said plug shell against said flange.

7. The improvement according to claim 5, wherein said conductive solid spring washer means is a wave washer.

8. The improvement according to claim 5, wherein said conductive solid spring washer means is made from beryllium copper alloy.

9. The improvement according to claim 8, wherein said conductive solid spring washer means is gold plated.

* * * * *